US005690130A

United States Patent [19]

Gunderman et al.

[11] Patent Number: 5,690,130

[45] Date of Patent: Nov. 25, 1997

[54] COSMETIC SAMPLER WITH INTEGRAL APPLICATOR

[75] Inventors: Anthony J. Gunderman, Phoenix; David Moir, Annapolis, both of Md.; Robert M. O'Connell, deceased, late of Belle Mead, N.J., by Jo O'Connell, executrix

[73] Assignee: Color Prelude Inc., Baltimore, Md.

[21] Appl. No.: 375,739

[22] Filed: Jan. 20, 1995

Related U.S. Application Data

[63] Continuation-in-part of Ser. No. 857,993, Mar. 26, 1992, which is a continuation-in-part of Ser. No. 306,394, Feb. 6, 1989, Pat. No. 5,192,386, which is a division of Ser. No. 199,175, May 26, 1988, Pat. No. 4,848,378, which is a division of Ser. No. 875,172, Jun. 17, 1986, Pat. No. 4,751,934.

[51] Int. Cl.[6] ..... A45D 34/00

[52] U.S. Cl. ..... 132/319; 206/823

[58] Field of Search ..... 132/293, 294, 132/317, 320, 312, 314; 206/572, 581, 229, 438, 823

[56] References Cited

U.S. PATENT DOCUMENTS

| | | | |
|---|---|---|---|
| 1,743,512 | 1/1930 | Aisen | 132/312 |
| 1,744,532 | 1/1930 | Ean | 132/312 |
| 1,836,833 | 12/1931 | Ames | 15/104.9 |
| 1,885,076 | 10/1932 | Bustamante | 132/320 |
| 2,061,139 | 11/1936 | Cohen | 206/489 |
| 2,088,076 | 7/1937 | Winslow | 434/100 |
| 2,133,914 | 10/1938 | Burke | 156/250 |
| 2,175,133 | 10/1939 | Singleton | 132/317 |
| 2,185,386 | 1/1940 | Valentine | 53/450 |
| 2,214,510 | 9/1940 | Robinson | 132/314 |

(List continued on next page.)

FOREIGN PATENT DOCUMENTS

| | | |
|---|---|---|
| 0197184 | 7/1985 | European Pat. Off. . |
| 0197206 | 12/1985 | European Pat. Off. . |
| 01977206 | 12/1985 | European Pat. Off. . |
| 0263327 | 9/1987 | European Pat. Off. . |
| 2589271 | 10/1986 | France . |
| 2601865 | 1/1988 | France . |
| 53-116906 | 10/1978 | Japan . |
| 56-108703 | 8/1981 | Japan . |
| 57-37560 | 3/1982 | Japan . |
| 58-162677 | 9/1983 | Japan . |

(List continued on next page.)

OTHER PUBLICATIONS

E. Noteboom, "Screen Printing: Where Did It All Begin?", Screenprinting, p. 52–56, 103, 122 (1992).

"A Series of Well-Known and Widely Used Techniques (Cosmetic Items and Containers)", Japanese Patent Office Gazette (1955).

"Practical Technique for Screen Printing" Tech. Report No. 45 (1958).

(List continued on next page.)

*Primary Examiner*—Todd E. Manahan

*Attorney, Agent, or Firm*—Ostrolenk, Faber, Gerb & Soffen, LLP

[57] ABSTRACT

A cosmetic sampler with an integral applicator in which the unit dose of cosmetic is screen printed onto a paper base. To prevent off-set of the cosmetic sample and to protect the integral applicator during packaging and handling, a protective thin film overlay is laminated to a perimeter adhesive printed on the paper base around the cosmetic and the applicator. The applicator is glued as a laminate to the base and die cut in a desired shape, flocked to the base and die cut, or flocked into a debossed/embossed well formed in the base with the cosmetic sample screen printed directly thereover. The sampler with integral applicator of the present invention can be used for sampling unit doses of powders, creams, lipsticks, fragrances, pharmaceuticals, lotions, and sundries.

40 Claims, 11 Drawing Sheets

U.S. PATENT DOCUMENTS

| | | | |
|---|---|---|---|
| 2,234,657 | 3/1941 | Smaldone | 132/285 |
| 2,378,935 | 6/1945 | Kraft | 132/73 |
| 2,557,141 | 6/1951 | Rebora | 132/294 |
| 2,561,400 | 7/1951 | Morrell | 132/314 |
| 2,735,435 | 2/1956 | Feinstein | 132/320 |
| 2,775,247 | 12/1956 | Morrell | 132/312 |
| 2,775,248 | 12/1956 | Morrell | 132/312 |
| 2,775,249 | 12/1956 | Morrell | 132/318 |
| 2,998,821 | 9/1961 | Hurdel | 132/218 |
| 3,157,912 | 11/1964 | Lisczawka | 425/2 |
| 3,568,684 | 3/1971 | Reece | 132/333 |
| 3,779,848 | 12/1973 | Maierson | 156/178 |
| 3,788,917 | 1/1974 | Linda | 156/82 |
| 3,811,987 | 5/1974 | Wilkinson et al. | 156/497 |
| 3,860,016 | 1/1975 | Macklerman | 132/317 |
| 3,888,689 | 6/1975 | Maekawa et al. | 106/24 |
| 4,224,092 | 9/1980 | Thompson et al. | 156/82 |
| 4,372,098 | 2/1983 | Mason | 53/412 |
| 4,372,331 | 2/1983 | Thompson | 132/320 |
| 4,487,801 | 12/1984 | Turnbull et al. | 428/313.5 |
| 4,493,869 | 1/1985 | Sweeney et al. | 428/201 |
| 4,611,611 | 9/1986 | Beal, Jr. | 132/320 |
| 4,661,388 | 4/1987 | Charbonneau | 428/43 |
| 4,725,495 | 2/1988 | Garbe et al. | 428/335 |
| 4,735,827 | 4/1988 | Frank et al. | 427/264 |
| 4,747,782 | 5/1988 | Campbell, Jr. | 434/377 |
| 4,751,934 | 6/1988 | Moir et al. | 132/79 D |
| 4,752,496 | 6/1988 | Fellows et al. | 427/485 |
| 4,755,433 | 7/1988 | Patel et al. | 428/422 |
| 4,774,133 | 9/1988 | Doree et al. | 428/321.5 |
| 4,805,773 | 2/1989 | Sabongi | 206/581 |
| 4,824,143 | 4/1989 | Grainger | 283/56 |
| 4,848,378 | 7/1989 | Moir et al. | 132/319 |
| 4,876,136 | 10/1989 | Chang et al. | 428/130 |
| 4,884,680 | 12/1989 | Israel et al. | 206/44.11 |
| 4,884,719 | 12/1989 | Levine et al. | 221/25 |
| 4,889,755 | 12/1989 | Charbonneau | 428/42 |
| 4,890,872 | 1/1990 | Parrotta et al. | 283/56 |
| 4,925,667 | 5/1990 | Fellows et al. | 132/293 |
| 4,940,584 | 7/1990 | Tararuj et al. | 424/401 |
| 4,952,400 | 8/1990 | Tararuj et al. | 424/401 |
| 4,988,557 | 1/1991 | Charbonneau | 428/204 |
| 4,995,408 | 2/1991 | Wallschaeger | 132/320 |
| 4,996,044 | 2/1991 | Mercado et al. | 424/64 |
| 5,000,202 | 3/1991 | Stepan | 132/320 |
| 5,031,647 | 7/1991 | Seidler | 132/320 |
| 5,037,139 | 8/1991 | Schoenleber et al. | 283/56 |
| 5,072,831 | 12/1991 | Parrotta et al. | 206/232 |
| 5,161,688 | 11/1992 | Muchin | 206/484 |
| 5,192,386 | 3/1993 | Moir et al. | 156/268 |
| 5,301,697 | 4/1994 | Gueret | 206/823 |
| 5,348,031 | 9/1994 | Cloud | 132/317 |
| 5,391,420 | 2/1995 | Bootman et al. | 428/195 |

FOREIGN PATENT DOCUMENTS

| | | |
|---|---|---|
| 58-163420 | 9/1983 | Japan . |
| 59-22473 | 2/1984 | Japan . |
| 59-82414 | 6/1984 | Japan . |
| 60-67408 | 4/1985 | Japan . |
| 60-129206 | 8/1985 | Japan . |
| 60-178356 | 9/1985 | Japan . |
| 60-149314 | 10/1985 | Japan . |
| 61-56602 | 3/1986 | Japan . |
| 1329309 | 9/1973 | United Kingdom . |
| WO8807825 | 10/1988 | WIPO . |

OTHER PUBLICATIONS

"Photomechanical Process Silk Screening" (1972).

"New Screen Printing Technology Complete Collection", vol. 4, *Various Applied Theories of Screen Printing*, pp. 47–49, Seri Graph Co. (Feb. 25, 1986).

Kirk Othmer, Encyclopedia of Chemical Technology, vol. 6, 2nd Ed., Sep. 1965, pp. 363–366.

FIG. 7A
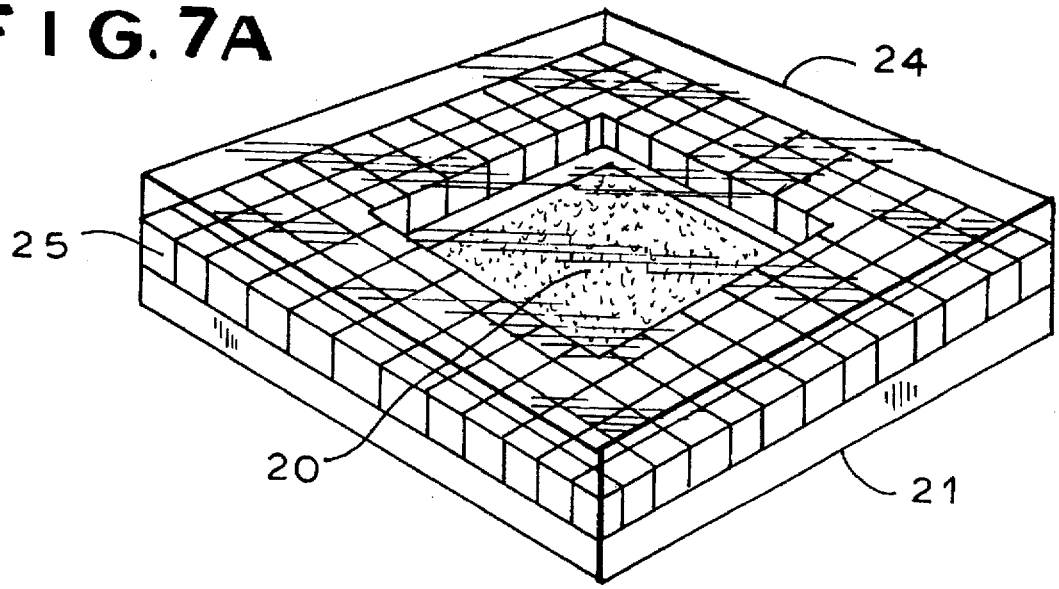
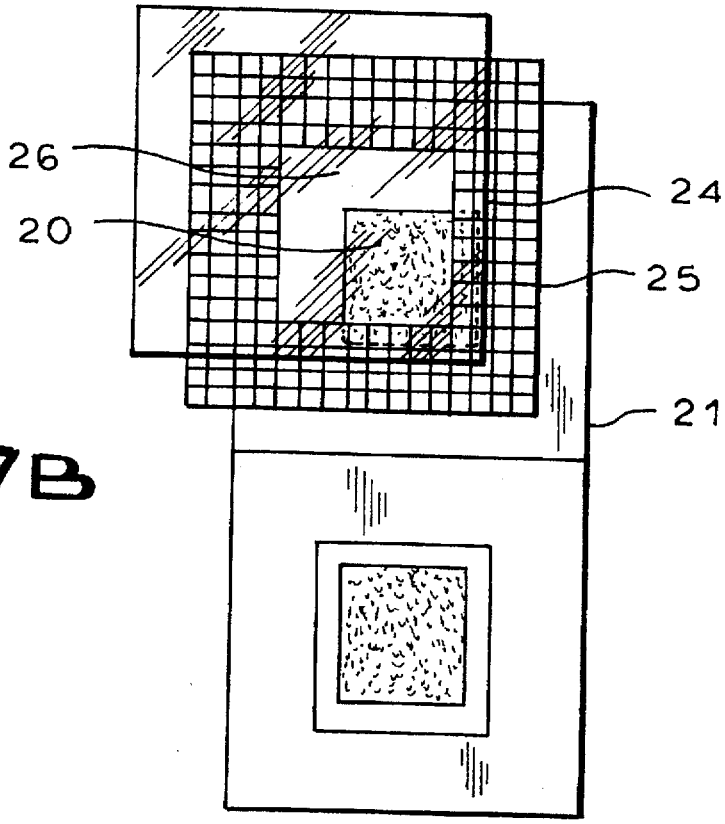
FIG. 7B
FIG. 7C
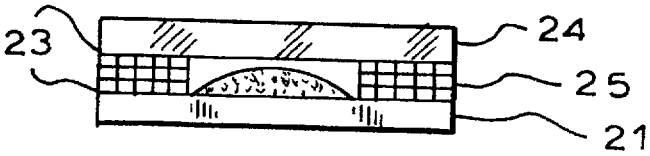

FIG.8A
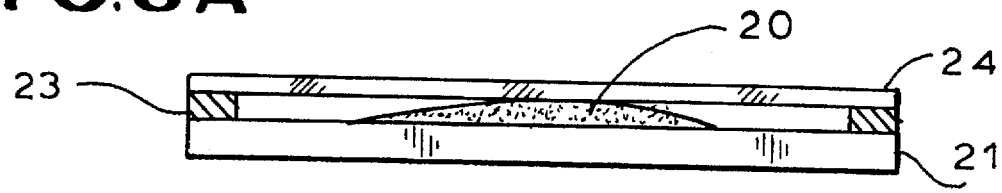
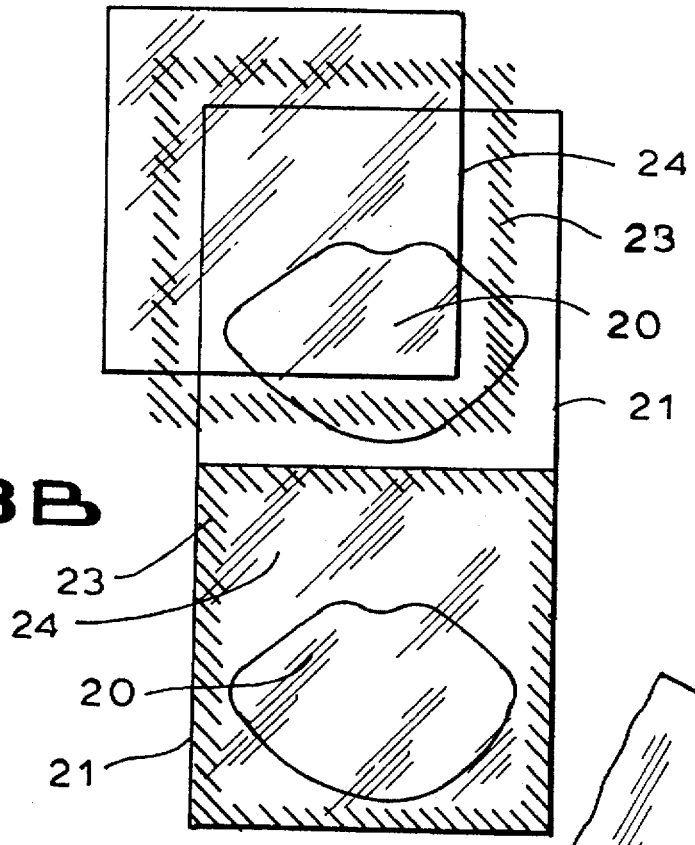
FIG.8B
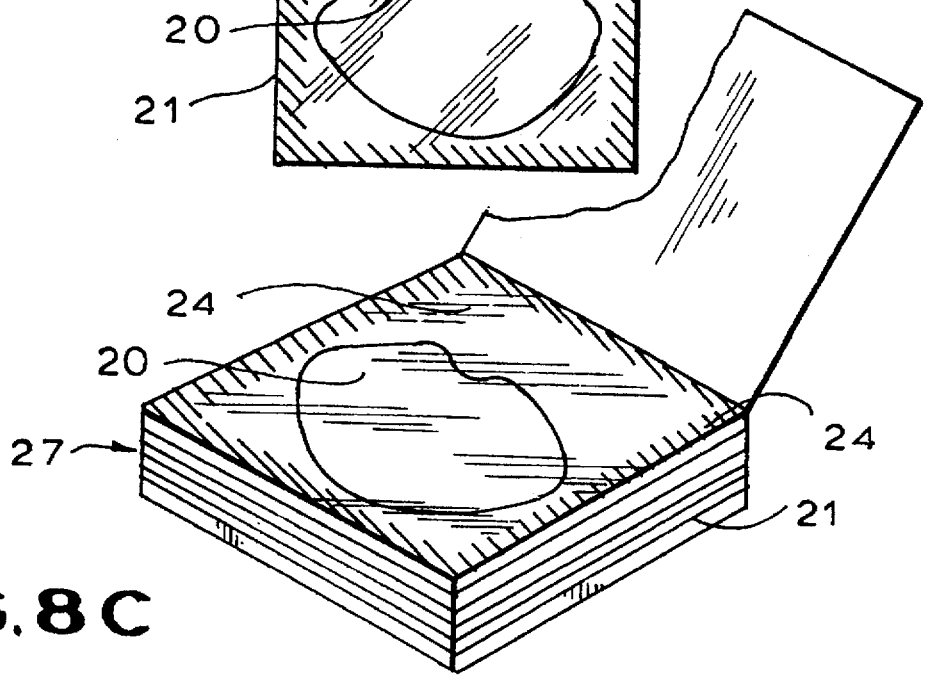
FIG.8C

FIG. 10A
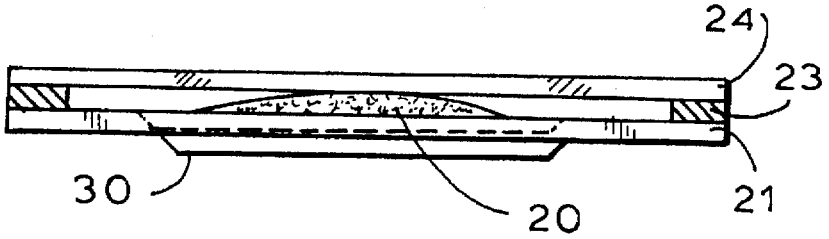
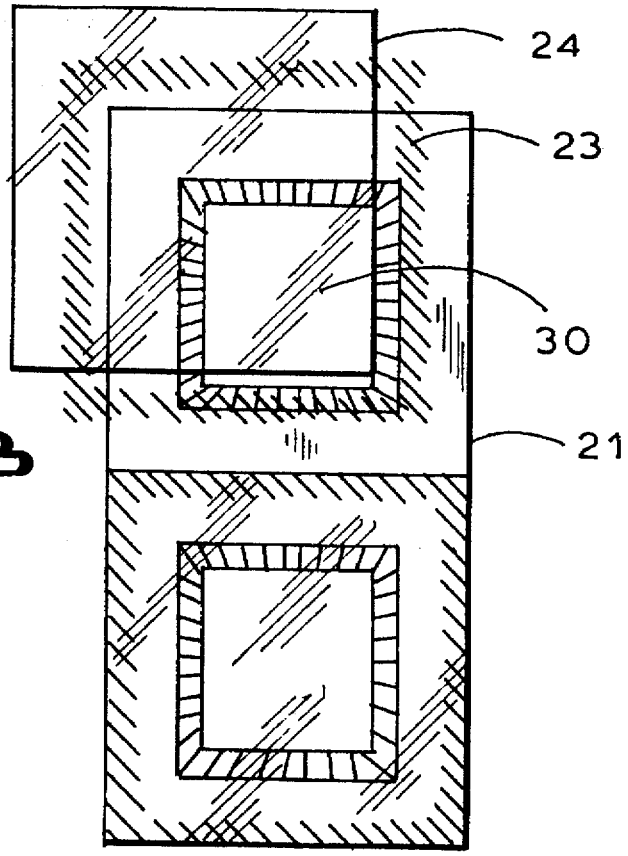
FIG. 10B
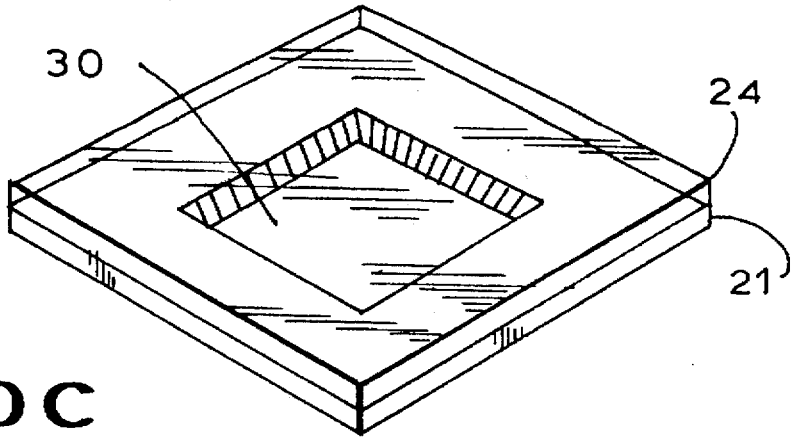
FIG. 10C

COSMETIC SAMPLER WITH INTEGRAL APPLICATOR

RELATED APPLICATIONS

This is a continuation-in-part of U.S. application Ser. No. 07/857,993, filed Mar. 26, 1992, pending which is a continuation-in-part of U.S. application Ser. No. 07/306,394, filed Feb. 6, 1989, now U.S. Pat. No. 5,192,386, which is a division of U.S. application Ser. No. 07/199,175, filed May 26, 1988, now U.S. Pat. No. 4,848,378, which is a division of U.S. application Ser. No. 06/875,172, filed Jun. 17, 1986, now U.S. Pat. No. 4,751,934. The disclosures of each of the above-noted related applications are herein incorporated by reference.

BACKGROUND OF THE INVENTION

1. Field of the Invention

The present invention relates to a cosmetic sampler, and more specifically, to a disposable unit dose or single application package for providing a cosmetic sample, the package including an integral applicator.

2. Description of the Related Art

Cosmetics have typically been available for sampling in department stores in the very containers in which the product is sold, or in smaller versions of the same container. With this method of marketing a cosmetic can become quite expensive and can create an uneasiness in the consumer since others "have been in the same pot."

Moreover, to date, there has been no inexpensive and convenient method of marketing cosmetics by hand-outs or by mail, e.g., as inserts which accompany department store bills, other than cosmetic "strips", which consist merely of make-up samples deposited on a substrate covered by a paper mask. Such "strips" do not allow for the presentation of the cosmetic sample in a design pattern, nor do they allow for the simultaneous presentation of a number of colors in a single design.

Similar problems arise in the distribution of samples of creams, lipsticks, fragrances, pharmaceuticals, lotions, and other types of high viscosity, waxy materials.

SUMMARY OF THE INVENTION

Accordingly, one object of the present invention is to provide an inexpensive sanitary unit dose package which allows the consumer to sample a cosmetic, cream, lipstick, fragrance, pharmaceutical, lotion, or other high viscosity, waxy material without fear of contracting disease.

A second object of the present invention is to provide an inexpensive unit dose package which can be distributed as a hand-out or placed in mailers.

A third object of the present invention is to provide a unit dose package for presenting samples to customers in a variety of aesthetically appealing designs and colors.

Another object of the invention is to incorporate an applicator in the unit dose package.

Briefly, the present invention is a cosmetic sampler package comprising a paper based substrate screen printed with a slurry of make-up and solvent. An integral applicator is provided for applying the cosmetic. A perimeter adhesive is printed around the make-up, and a protective thin film overlay is laminated thereon.

In a second embodiment, a pressure sensitive adhesive stock with a removable liner is used. The resultant product is then die cut into samples which can be applied to any labelable substrate.

In a third embodiment, the conventional single-layer pressure sensitive substrate base is replaced with a two-layer pressure sensitive stock having a non-pressure sensitive removable adhesive between the two layers. This construction yields a roll form label similar to that of the second embodiment, but which has the additional feature of being removable without residual tackiness.

In a fourth embodiment, the pressure sensitive base of the second or third embodiment is applied to a coupon stock.

In a fifth embodiment, the coupon of the fourth embodiment is fully covered with unit dose cosmetic samples.

In still further embodiments, the present invention can be provided as a folded sheet hand-out or as a pad of stacked samplers.

The present invention can also be used to provide unit doses of creams, lipsticks, fragrances, pharmaceuticals, lotions, and other high viscosity, waxy materials.

Other features and advantages of the invention are described below, with reference to the accompanying drawings.

BRIEF DESCRIPTION OF THE DRAWINGS

FIGS. 7A, 7B, and 7C show the lipstick sampler embodiment of the present invention with a spaced well using a laminate.

FIGS. 8A, 8B, and 8C show the lipstick sampler embodiment in the individual sampler and padded sampler forms.

FIGS. 10A, 10B, and 10C show the lipstick sampler embodiment of the present invention with a debossed well.

DETAILED DESCRIPTION OF THE PREFERRED EMBODIMENT

Figure 1A:
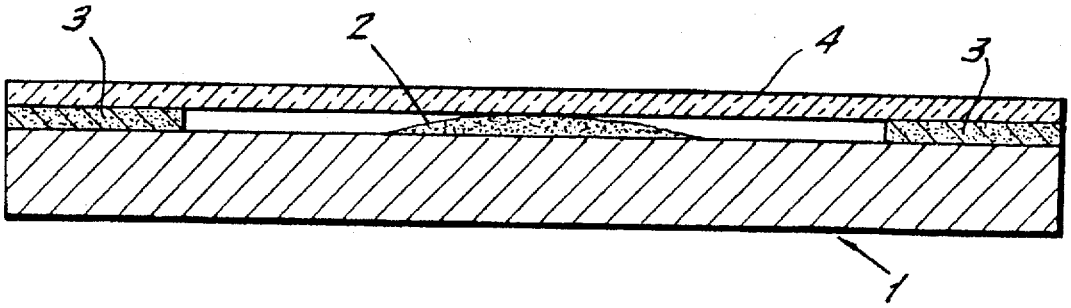
FIGS. 1A and 1B show a side cut-away view and top view, respectively, of the present invention.

Referring first to FIG. 1A, the present invention comprises a coated cover substrate 1, upon which is screen printed a cosmetic powder or make-up 2 in any desired pattern. A perimeter adhesive 3 is applied to the coated face stock 1, and a two mil. polypropylene clear cover sheet 4 is laminated over the make-up 2. Cover 4 serves to prevent offset and projects the image of a clean, sanitary product.

Figure 1B:
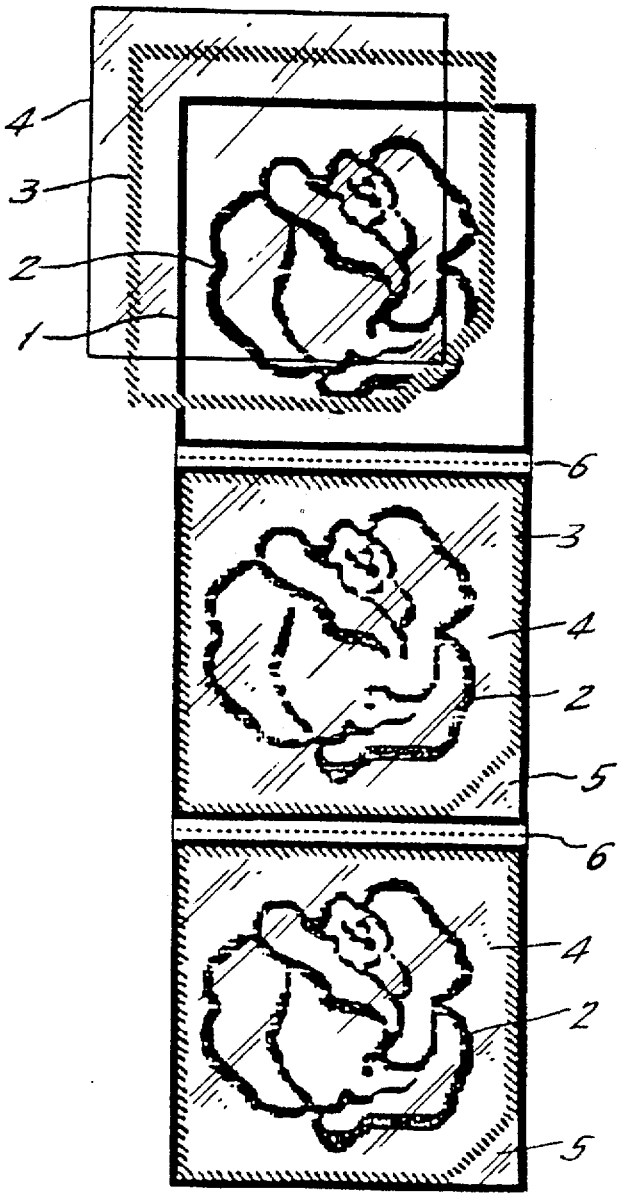

Referring now to FIG. 1B, a small void 5 in the perimeter adhesive 3 in one corner of the cosmetic sampler 4 gives a starting point for the easy removal of the cover. As shown in FIG. 1B, the cosmetic sampler is manufactured in a strip of samples separated by perforations 6. This embodiment of the invention is a protected free-standing handout, i.e. for in-person disbursal by a sales agent.

The paper base 1 can be pre-printed on one or both sides or can be printed in line on one or both sides depending on the particular press configuration employed. Although it is not necessary to avoid printing under the cosmetic powder 2, most make-up is generally opaque, and any copy printed underneath the powder would be difficult to read. Printing the cosmetic over the pre-printed surface requires some registration device, such as a printed mark capable of being detected by an electric eye, or a hole or series of holes either detectable or usable as line feed holes, if the press is equipped with a tractor feed.

In the process for making the invention, the paper base 1 is run through the press and printed with as many colors of make-up 2 as required and allowed by the press configuration. These deposits of make-up may be in virtually any shape and size compatible with the press capability and may be in proximity and registered with each other. In a preferred embodiment, a moderately coarse mesh (125 threads per inch) from Advance Process Supply Co. and a sharp 80–85 durometer squeegee are used to deposit the make-up on the substrate. The mesh has an unusually fine thread for its count resulting in a smooth screen with a high percentage of open area.

The make-up slurry is formed by wetting the make-up with a solvent compatible with the chemistry of the powder. For instance, a pearlescent eyeshadow with inorganic pigments that wet well can be used with npropyl alcohol (an evaporating solvent). If a coarse screen and a poorly lubricated powder are used together, additional lubricant such as glycerine or silicon oil must be added to the slurry. The viscosity of the slurry and the amount of solvent added must be tailored to the individual powder, as is the choice and amount of lubricant, although the amount of lubricant should preferably be kept below 5%. Following screen printing of the slurry, the solvent evaporates to leave a sample of make-up 2 on the base 1.

Next, the applicator can be printed or attached to the substrate as a laminate or glued in strips, and die-cut to the desired shape. In one embodiment, an adhesive is printed on the substrate. Fibers such as cotton, nylon, or acrylic are introduced into a chamber and by electrostatic assist the fibers are flocked on the substrate. Using flocking, the fabric fibers can be applied in a chosen register or pattern to form the applicator. The applicator is then die cut to the desired shape while still being attached to the unit.

In another embodiment, the applicator material is applied in a pattern onto the substrate. The material area is embossed/debossed, and the product is printed directly on the applicator material so that the product and applicator function as a single unit, a product and applicator in one.

Next, the perimeter adhesive 3 is printed on paper substrate 1, and the protective overlay 4 is laminated to the adhesive. The adhesive 3 is preferably, but not necessarily, pressure sensitive. It can consist of an anaerobic, a self crosslinking, a U.V. curable, a heat curable material, or it can simply be dried by evaporation. In the preferred embodiment, a U.V. crosslinked pressure sensitive adhesive is used for ease of operation. The protective overlay 4 can be a glassine sheet or a film such as a 2 mil. polypropylene, or a more opaque sheet, depending on the effect desired. In any event, however, the protective overlay 4 must be strong enough to be removed cleanly from the adhesive selected; i.e., it cannot tear upon removal. The finished lamination can then be perforated, die cut and finished in any configuration desired.

In a typical application, the product would be produced in a strip of five samples separated by perforations and packaged ten strips to a polybag. These samples could be torn off the strip and handed to the customer for demonstration of the product. Individual samples would contain enough powder for one application of the cosmetic, but not so much that it would substitute for a sale to the consumer.

Figure 2A:
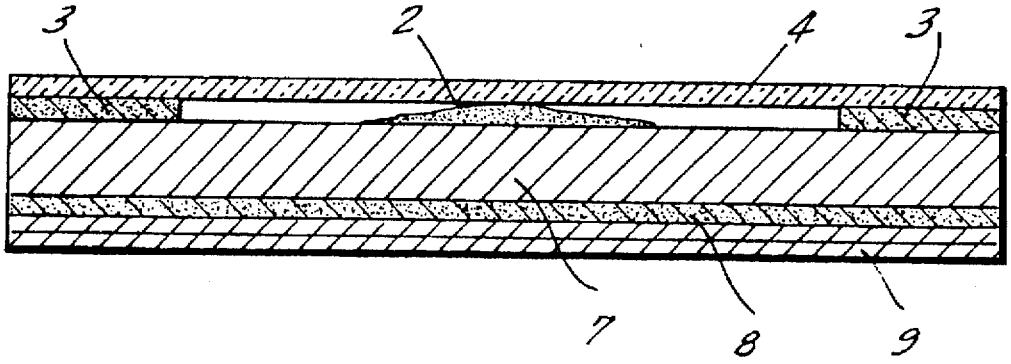
FIGS. 2A and 2B show a side cut-away view and top view, respectively, of a second embodiment of the present invention in which the base stock is replaced by a pressure sensitive material to yield a label.
Figure 2B:
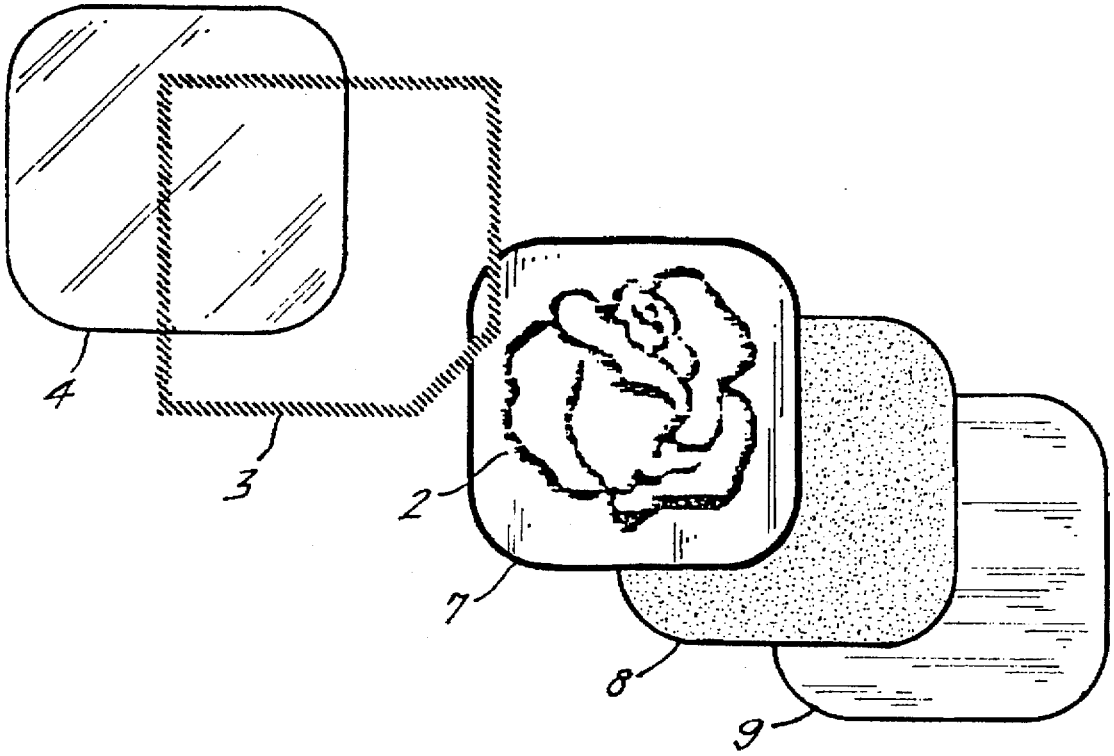

In a second embodiment of the invention, shown in FIGS. 2A and 2B, the paper base substrate is replaced by an adhesive coated base material. The base material 7 can comprise, for example, a high gloss face stock and the adhesive 8, coated on the underside of the base, can be of a pressure sensitive, heat seal, water or solvent activated type. A liner 9 covers the pressure-sensitive adhesive. In the preferred embodiment, liner 9 is a kraft type liner, but it can also be a glassine, plastic film paper film laminate, or a layered paper. Alternatively, the base can be simply a raw stock capable of being glued onto a product by the manufacturer.

Following lamination of the protective cover sheet 4, in the preferred embodiment, the product is die cut and matrix stripped to convert the product into labels. As mentioned previously, cover sheet 4 must have sufficient internal strength so that the weakest bond is the adhesive-laminate bond, as is the case with any temporary laminate. After the product is die-cut, the individual pressure sensitive make-up samples are then applied either by hand or automatically to any labelable substrate, such as literature, a bill, a mailer, a magazine insert, bottles, or other containers, cartons, other labels or even directly on the cosmetic package.

Figure 3A:
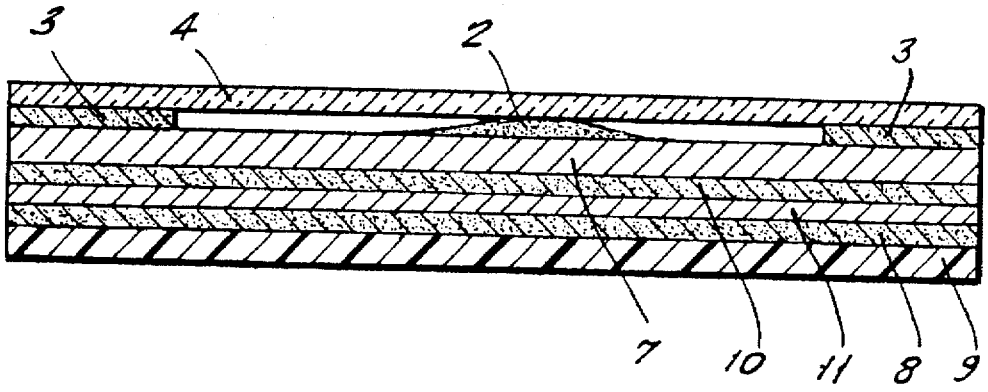
FIGS. 3A and 3B show a side cut-away view and top-view, respectively, of a third embodiment of the present invention similar to the second embodiment except that the conventional single-layer pressure sensitive base is replaced by a two-layer pressure sensitive stock having a non-pressure sensitive removable adhesive between the two layers, yielding a removable label without residual tackiness.
Figure 3B:
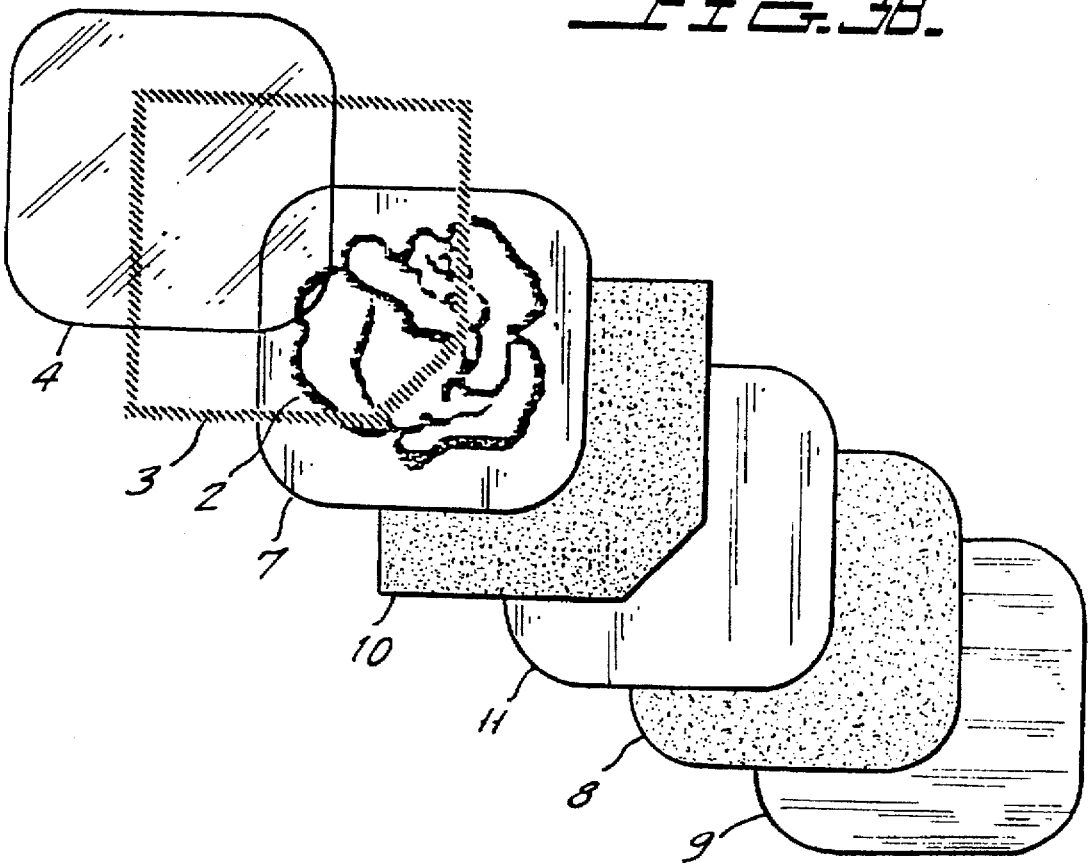

In a third embodiment of the invention, shown in FIGS. 3A and 3B, the conventional, single-layer pressure-sensitive base stock of FIGS. 2A and 2B is replaced with two-layer pressure-sensitive stock having a non-pressure sensitive removable adhesive between the two layers. This yields a roll form label that may be used in any of the applications of the embodiment shown in FIGS. 2A and 2B. The label of this embodiment, however, has the additional feature of being removable, leaving behind a clear non-tacky film or a paper that can be provided with print which is exposed upon removal of the top layer.

To form the product according to this embodiment, a base material 11, preferably pressure sensitive, is run through a press. The base material can be a film or a paper coated with any compatible pressure sensitive adhesive 8 on a polysiloxane coated release liner 9. Preferably, a polypropylene, acetate, polystyrene, or a paper substrate is used. This substrate may be printed and is then coated with a non-pressure sensitive removable adhesive 10 (either full coat or patterned). Such an adhesive can be obtained commercially or formulated from a variety of materials including, but not limited to, latex, EVA (a polymerized ethyl vinyl acetate), EVOH (a polymerized ethyl vinyl alcohol), PVA (a polyvinyl alcohol), brominated PVA and crosslinking elastomers.

An unsupported paper, foil or film base 7 is then laminated to the adhesive surface. The top material may be, but does not have to be, printed. The result is a two-layer construction which can be applied to a product and separated by peeling off the top layer, yielding a non-tacky sheet and leaving a non-tacky base on the product. The two-layer paper or label is run through a screen press and printed with the make-up powder, then laminated and die cut. The result is a label that can be applied to a product, package or piece of printed material, but which can be removed from that product prior to the removal of the samples' cover and its use. The material left behind has no tacky residue, the background being opaque or transparent, printed or plain, as desired in the particular application.

Figure 4A:
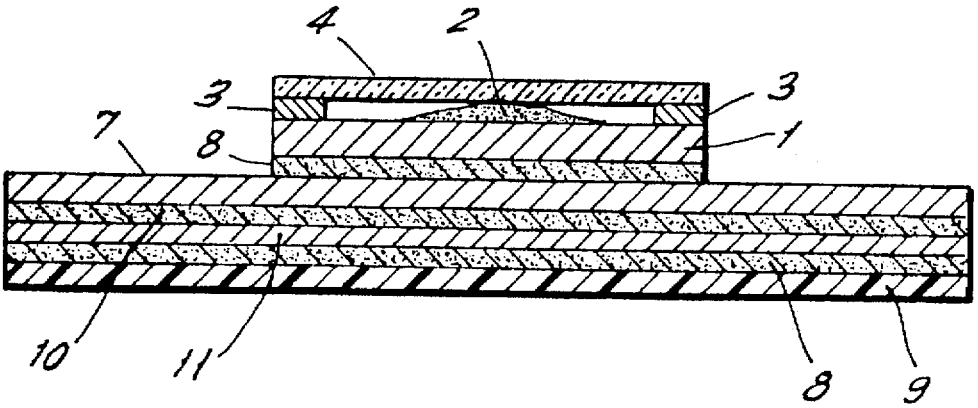
FIGS. 4A and 4B show a side cut-away view and top view, respectively, of a three-layer embodiment of the present invention in which the cosmetic sample is applied to a coupon.
Figure 4B:
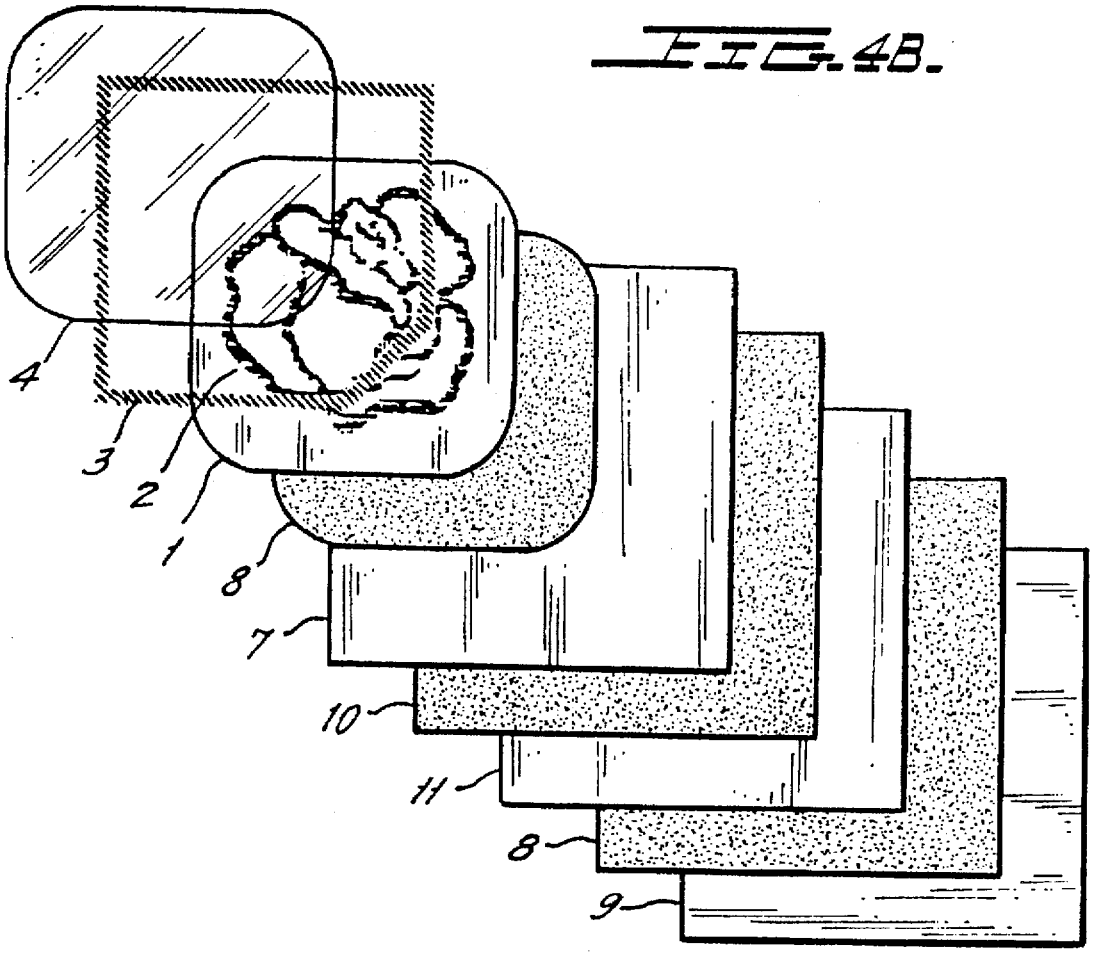

In a fourth embodiment of the invention, shown in FIGS. 4A and 4B, the two-layer cosmetic sampler label of the third embodiment is applied to a coupon in the form of, for example, an instant redemption coupon, a mail-in rebate or other promotion. The three-layer construction may comprise a sample of the product or some companion product, a cents-off coupon for this or the companion product, and other instructional or advertising information, or a clear base that does not interfere with package graphics.

A conventional single-layer cosmetic sampler of the second embodiment can also be used if the "coupon" is designed to be used after purchase. One addditional feature that may be incorporated into the larger two-layer removable label is a strip of permanent adhesive printed along one edge to give a more easily applied coupon with no danger of accidental pre-separation of the two layers. This adhesive, usually a self-cross linking acrylic, is kept narrow enough so that it does not interfere substantially with the complete removal of the coupon.

Figure 5A:
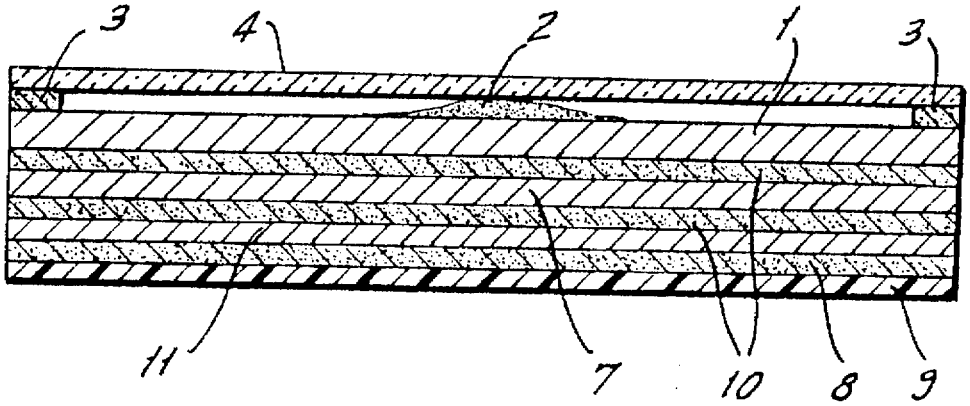
FIGS. 5A and 5B show a side cut-away view and top view, respectively, of a three-layer embodiment of the present invention in which a coupon is fully covered with the cosmetic sample.
Figure 5B:
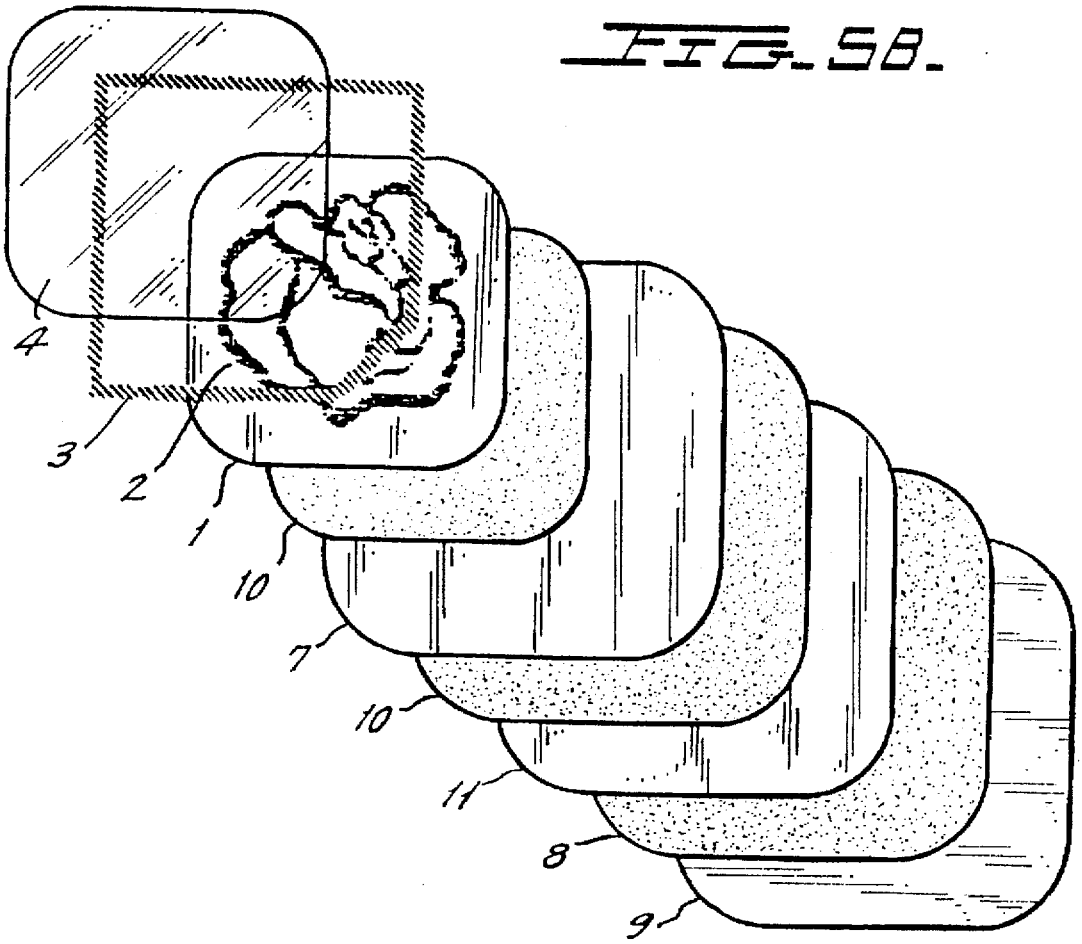

A fifth embodiment of the invention, shown in FIGS. 5A and 5B, is a three-layered construction prior to the screen press. A pressure sensitive base material is run through a press, preferably a Flexographic press. As stated previously, the base material can be a paper foil or film and preprinted, or printed during the press pass. The material is full or pattern coated with the removable, non-pressure sensitive adhesive 10 and possibly a narrow permanent edge bonding adhesive. A second web, which may also be pre-printed, blank or printed in-line during the process, is introduced to the wet adhesive surface, and is itself coated with a similar adhesive or a pair of adhesives.

A third web, as in the fourth embodiment described above, is then introduced and the finished construction is run through the screen press to be printed with the make-up and laminated. This embodiment of the invention is especially useful to sample several colors on package with a mail-in order form or coupon for a companion product, with the stay behind base indicating that the coupon and samples have been removed.

All of the above embodiments of the present invention described above have the form of a protected "sanitary" means of make-up sample presentation. Obviously, the invention could be presented without the propylene cover, provided that handling techniques and stock selections are employed to avoid off-set. A major problem, of course, with unprotected versions is abrasion in packaging.

Figure 6:
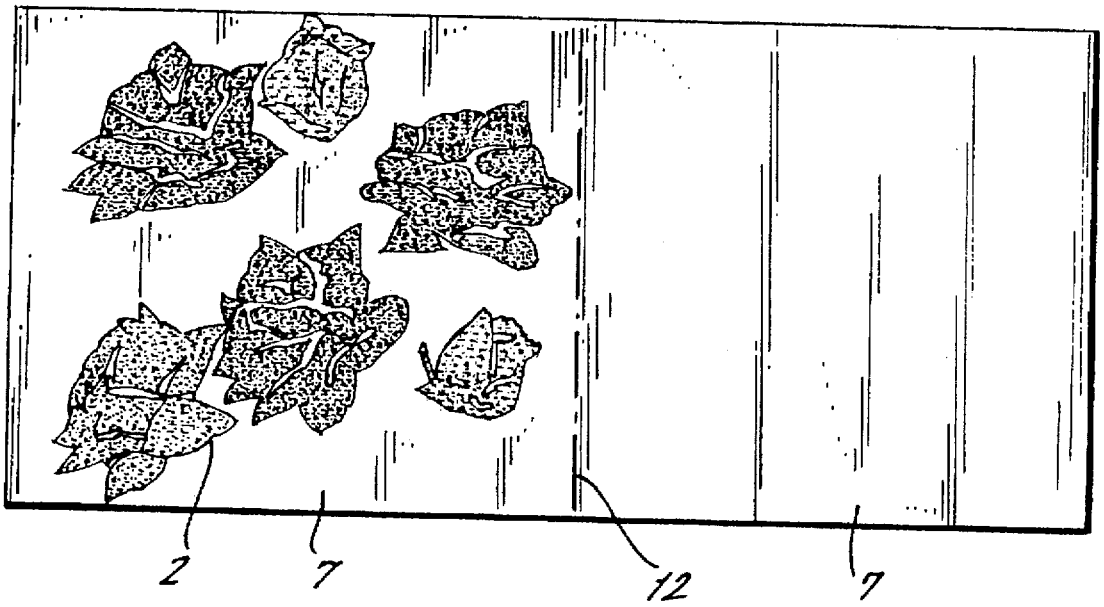
FIG. 6 shows a foldable "hand-out" embodiment of the present invention.
Figure 9:
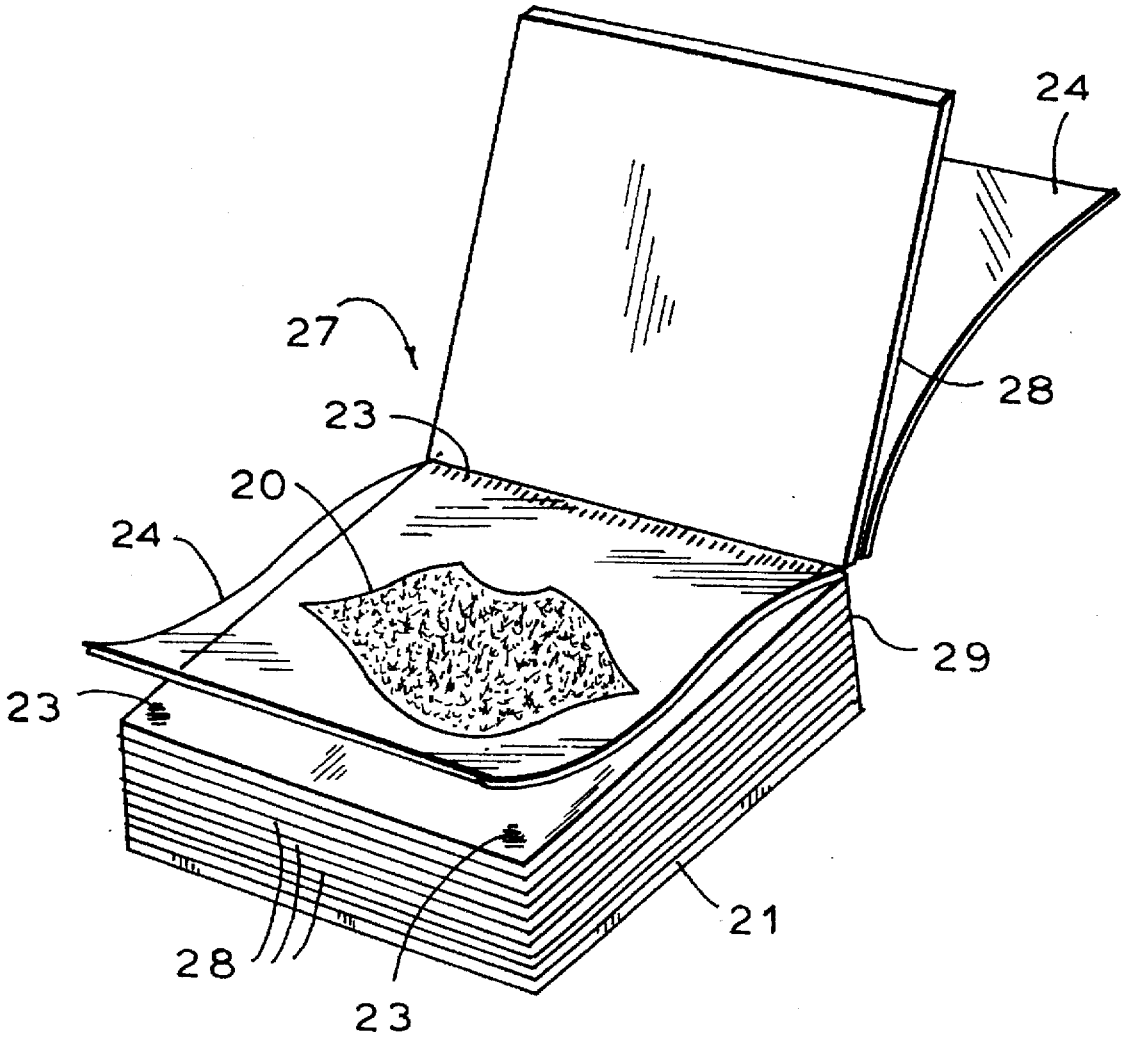
FIG. 9 is an illustrative view of the lipstick sampler pad.

One way to solve this problem is by inter-leaving or folding one side of the web over the printed make-up, resulting in a convenient "handout" embodiment of the invention, as shown in FIG. 6. This product is formed by running a high quality C2S web through a screen press. Optionally, the web can be preprinted with high-quality graphics, including four-color process copy. Make-up 2 is printed on the sheet 7 and, with the assistance of a perforation or score 12, the sheet is folded at the end of the press. The folded sheet provides necessary protection to allow handling and distribution of the non-laminated free-standing handout.

In a still further embodiment of the invention, a padded or stacked sheet of unit dose samples is formed. The high quality C2S sheet referred to in the previous embodiment is run through the web screen press (after preprinting, if desired) and the make-up sample is printed onto it and laminated fully or only over the make-up sample, if desired. The printed web is then sheeted and stacked with appropriate chipboard backing and cover sheets, and is then padded. The result is a pad that can be incorporated into a make-up display similar to the cakes that are currently used, except that each customer now is able to tear off a clean sheet that has not already been handled by other customers.

The use of screen techniques according to the present invention for preparing make-up samples is not limited to samples of eyeshadows or other inorganically pigmented powders. Organically pigmented powders may also be sampled by adjusting the solvent system and by, if necessary, reducing the pigment loading to compensate for the tendency of some organic pigments to develop in a liquid medium. Such a technique would also allow the sampling of blushers.

The laminated techniques described above also lend themselves to sampling non-liquid but oily products, such as lipstick, sunscreen stick, stick deodorant, or any oily, non-liquid pharmaceutical product. A screen press with a heated steel mesh or a flexographic process with heated pans and cylinders allows the handling of high-viscosity oils or waxes that drop in viscosity when heated. These materials flow well enough when hot to be forced through a mesh or transferred through a roller train passing from the hotter surface to the cooler one. These products require the laminated cover (i.e. they can never be folded or stacked in a pad) as they are never truly dry, and would offset under pressure if rerolled without protection. Although this method of delivery is thus more limited than that for drier powders, it has great advantages over the current methods of sample distribution which are either expensive (individual lipstick tubes) or very messy and unsanitary (community lipstick pots).

An embodiment of the present invention for sampling fragrances will now be described.

To create a fragrance sampler, a mixture of a polymeric dispersion of polymer, co-polymer, plasticizers, fragrance oil and a suitable fragrance solvent, such as ethyl alcohol, is formed and screen printed onto a suitable substrate. The substrate is preferably formed of polyester film, although polyester board, poly-coated paper or coated board may also be used.

The printed polymeric fragrance mixture is rapidly dried and then sealed with a film overlay which attaches to an adhesive printed on the substrate. The substrate can be coated with a release coat before printing of the polymeric fragrance mixture to facilitate release of the mixture from the substrate and transfer to the film overlay upon separation of the overlay from the substrate, thus allowing the scent of the fragrance to emanate to the user. Since both the fragrance and the substrate (preferably polyester film) are transparent, the sampler can be applied (via a pressure sensitive adhesive backing) to secondary cartons, primary containers, or advertising inserts such as are found in magazines or mailing inserts without blocking visibility of the advertisement underneath the fragrance sample. Alternatively, pigments, dyes, talc, or nacreous pigment can be added to the polymeric fragrance mixture as a slurry or dispersion to make the sample opaque without affecting the scent of the fragrance sample.

The screen printed fragrance samples can be finished as individuals, sheets, rolls or pads as described above in connection with the cosmetic samples.

A yet another embodiment provides a more effective method of screen printing and sampling wax based products such as lipstick. By way of example, a method of screen printing lipstick is described, although the method is similarly applicable to any type of wax based product.

First, the lipstick bulk is heated above its melting point of approximately 195° to 205° F. to ensure that the highest melting point waxes are dispersed, and that the lipstick is uniform. The formulation is then augmented by the addition of molten waxes and other additives which are mixed until uniform and poured when molten into a stainless steel jacketed kettle or a suitably sized plastic container. The mixture is then allowed to cool to return to a solid state. The purpose of adding waxes to the formula is to prevent the lipstick from melting or bleeding oil when exposed to subsequent environmental conditions.

After cooling, the mixture forms a hard waxy product which is not printable. Thus, the next step is to change the material to a paste-like consistency using a conventional recognized method of grinding or shearing such as by a Rollermill or planetary mixer.

The paste-like processed bulk is added to the screen press at room temperature and printed in a pattern onto a suitable substrate, which can be board, paper or film. The board or paper should have a suitable coating to prevent wicking of oils.

Since the material which now exists as a printed paste is not yet a lipstick, it is then heated to approximately 195° to 200° F. to re-melt, then chilled to form a lipstick. The resulting physical appearance of the lipstick print is shiny, glossy, and liquefied.

One further step in the process, which ensures that the lipstick will maintain its integrity when exposed to environmental conditions of heat or pressure, incorporates the printing of a protective overcoat on the printed lipstick. This overcoat is screen printed in the exact pattern as the printed lipstick. The overcoat serves not only to maintain the integrity of the lipstick, but also to prevent product transfer to the film overlay, which is the final step in the printing process. The overcoat can be selected from a series of polymers which are screen printed from a solvent system, allowing rapid drying and forming of a uniform film over the lipstick surface. The overcoat material is dried to a uniform film by use of air knives or moving room temperature air. Polymer systems, based upon cellulosics, polyvinyl pyrollidone, pyrollidone ester blends, acrylics, nitrocellulose, have shown to have certain degrees of effectiveness; however, the material of choice for the overcoat is "NO'TOX"™ from Colorcon Incorporated, Philadelphia, Pa.

To prevent offset, the substrate is preferably debossed or layered with a cut-out forming a well (FIGS. 7A–C and 10A–C), such that the screen printed lipstick lies beneath the upper surface of the substrate, thus preventing the lipstick from contacting the plastic film overlay.

Referring to FIGS. 7A, 7B, and 7C, the lipstick sample 20 and supporting coated substrate 21 lie beneath a polyester film overlay 24 by means of a spacing element 25. The spacing element 25 is similarly a coated board, paper, or film and includes a cutout 26. The cutout 26 is adapted to surround the lipstick sample 20 creating a well in which the sample 20 sits. The polyester film overlay 24 is attached to the spacing element 25 by means of an adhesive 23, and the spacing element 25 is similarly attached to the supporting coated substrate 21 by means of an adhesive 23. The resulting well prevents offset of the sample 20 onto the film overlay.

Similar to the spacing element embodiment, the substrate of the sampler can be formed with a debossed well 30 (FIGS. 10A–C) to space the screen printed lipstick 20 from the film overlay 24 to prevent offset. The substrate 21 for the debossed well embodiment is formed from board, coated board, or vacuum formed plastic.

When formed of board or coated board, the substrate 21 is pressed between male and female debossing dies (not shown) to form the debossed well 30. This pressing is done on-line, the lipstick sample being screen printed into the well in a subsequent step. When formed of plastic, the substrate is heated and passed over a vacuum in a male/female mold (not shown) forming the debossed well 30, then cooled. This process is performed off line; i.e. the debossed well in the vacuum formed plastic substrate is formed separately and prior to the manufacture of the lipstick sampler.

Since powdery cosmetics are less likely to offset than waxy lipstick samples, the substrate of a cosmetic powder sampler can be embossed, rather than debossed. An embossed substrate raises the sample and provides a more attractive display.

In a similar fashion to the cosmetic sampler, the lipstick sampler 20 may also be provided in a padded stack form. Referring to FIGS. 8A, 8B, 8C and 9, a pad 27 of individual lipstick samples is shown. In this embodiment, the polyester film overlay 24 is directly attached to the supporting substrate 21, i.e. spacing element 25 is not included and there is no well. To prevent offset of the lipstick, the lipstick is augmented with additional waxes (6–9%) for hardening the sample 20. Although the debossed well embodiment permits the use of a softer sample (with only 0–3% added waxes), the augmented sample (6–9% waxes) is sufficiently soft to demonstrate the product but also hard enough to prevent offset of the lipstick onto the overlay 24. The pad 27 includes a supporting substrate 21 and a plurality of web sheets 28 on which the lipstick samples 20 are added. The web sheets 28 are held in pad form by means of pad glue 29. A polyester film overlay 24 covers each sample 20 between the web sheets 28.

Figure 11:
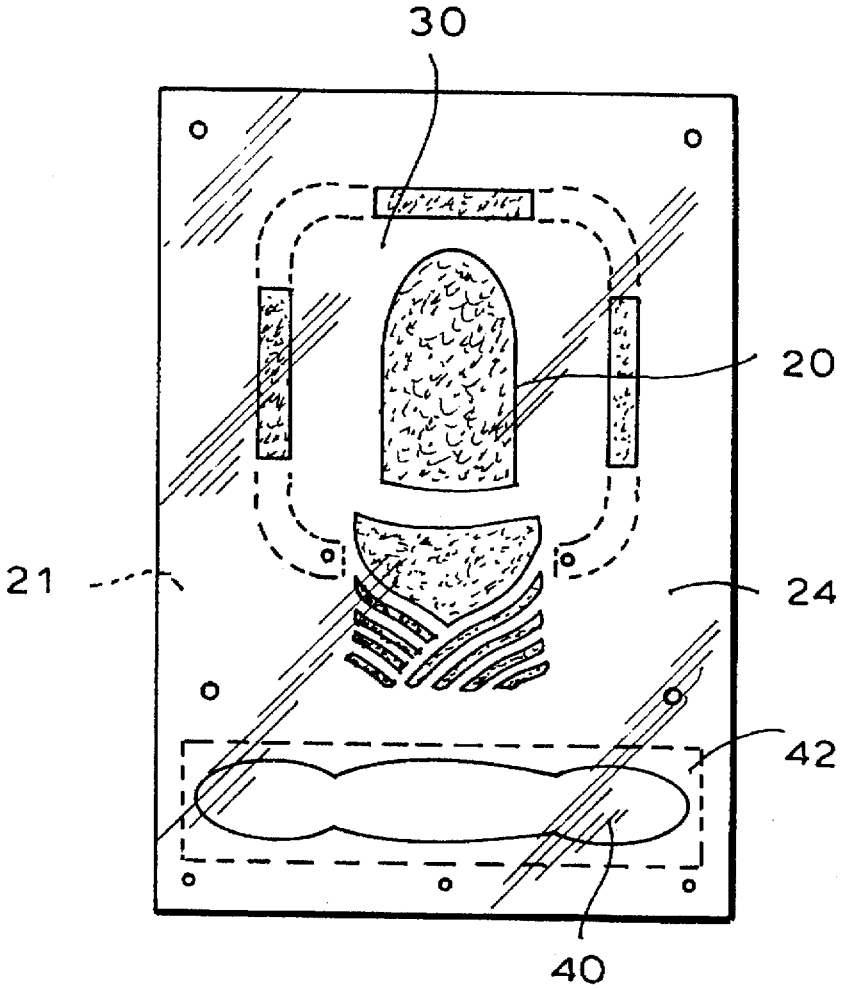
FIG. 11 is a top view of a lipstick sampler with an integral applicator.

FIG. 11 shows a further embodiment of the invention, which includes an integral applicator 40. If the cosmetic to be applied is a lipstick as shown in FIG. 11, applicator 40 can be attached to the sampler substrate 21 as a laminate or glued to substrate 21 in the form of a strip and then die-cut to the desired shape. Lipstick sample 2.0 and applicator 40 are preferably both covered by film overlay 24 or other suitable sealing material to maintain cleanliness prior to use.

An alternative method for making the integral applicator is to print adhesive onto substrate 21, introduce cotton, nylon, acrylic fibers or combinations thereof into a chamber and, with electrostatic assist, apply the fibers onto substrate 21 (a process called flocking). The fabric adhered to substrate 21 is then die cut to the desired shape to form applicator 40.

Figure 12:
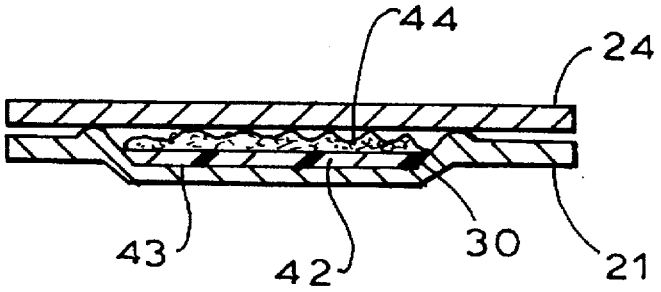
FIG. 12 is a cross-sectional view of a sampler with an integral applicator in a debossed well.

Another alternative method for making a sampler with an integral applicator, shown in FIG. 12, is to use the above-described flocking method to apply the applicator material (fibers) 42 in a pattern on a substrate 21, emboss/deboss the applicator area such that applicator 42 covers a well 43 in substrate 21, and then screen print a sample 44 of cosmetic directly onto applicator 42, so that cosmetic sample 44 and applicator 42 function as a single unit.

The above-described unit dose sampler with an integral applicator can be provided to sample and apply not only lipstick, but other cosmetics such as liquid make-up, eyeshadow, rouge, creams, fragrances, toiletries, etc. In addition, the integral applicator of the present invention can be used to sample sundries, such as toothpaste and shoe polish, for example.

Although the present invention has been described in connection with a preferred embodiment thereof, many other variations and modifications will now become apparent to those skilled in the art without departing from the scope of the invention. It is preferred, therefore, that the present invention be limited not by the specific disclosure herein, but only by the appended claims.

What is claimed is:

1. A cosmetic sampler, comprising:

a base having an upper surface;

a unit dose of cosmetic screen printed on the upper surface of said base at a first location; and an integral applicator for sampling said screen printed unit dose of cosmetic, said applicator being die-cut in a desired shape and disposed on the upper surface of said base at a second location different from said first location.

2. The cosmetic sampler of claim 1, wherein said base comprises a coated board.

3. The cosmetic sampler of claim 1, further comprising a perimeter adhesive applied on said base, and a protective overlay laminated to said base by said perimeter adhesive.

4. The cosmetic sampler of claim 3, wherein said protective overlay comprises a clear plastic sheet.

5. The cosmetic sampler of claim 1, wherein said applicator comprises a layer of fiber material laminated on said base.

6. The cosmetic sampler of claim 1, wherein said applicator comprises a layer of fiber material applied to said base with electrostatic assist.

7. The cosmetic sampler of claim 1, wherein said cosmetic comprises a powder.

8. The cosmetic sampler of claim 1, wherein said cosmetic comprises a cream.

9. The cosmetic sampler of claim 1, wherein said cosmetic comprises a lipstick.

10. The cosmetic sampler of claim 1, wherein said cosmetic comprises a fragrance.

11. The cosmetic sampler of claim 1, wherein said cosmetic comprises a pharmaceutical.

12. The cosmetic sampler of claim 1, wherein said cosmetic comprises a lotion.

13. A cosmetic sampler, comprising:

a base having an upper surface;

a debossed well formed in the upper surface of said base at a first location;

a unit dose of cosmetic screen printed in said debossed well; and an integral applicator for sampling said screen printed unit dose of cosmetic, said applicator being die-cut in a desired shape and disposed on the upper surface of said base at a second location different from said first location.

14. The cosmetic sampler of claim 13, wherein said applicator comprises a layer of fiber material applied to said base with electrostatic assist.

15. The cosmetic sampler of claim 13, wherein said applicator comprises a layer of fiber material laminated on said base.

16. The cosmetic sampler of claim 13, wherein said base comprises a coated board.

17. The cosmetic sampler of claim 13, further comprising a perimeter adhesive applied on said base, and a protective overlay laminated to said base by said perimeter adhesive.

18. The cosmetic sampler of claim 17, wherein said protective overlay comprises a clear plastic sheet.

19. A method of making a cosmetic sampler, comprising the steps of:

applying an integral applicator to an area on an upper surface of a base;

forming a debossed well in the area of the applicator on the upper surface of said base, such that said applicator is disposed within said well; and screen printing a unit dose of cosmetic directly over said integral applicator.

20. The method of making a cosmetic sampler as recited in claim 19, wherein said base comprises a coated board.

21. The method of making a cosmetic sampler as recited in claim 19, further comprising the step of apply a perimeter adhesive on said base, and laminating a protective overlay to said base by said perimeter adhesive.

22. The method of making a cosmetic sampler as recited in claim 21, wherein said protective overlay comprises a clear plastic sheet.

23. The method of making a cosmetic sampler as recited in claim 19, wherein said cosmetic comprises a powder.

24. The method of making a cosmetic sampler as recited in claim 19, wherein said cosmetic comprises a cream.

25. The method of making a cosmetic sampler as recited in claim 19, wherein said cosmetic comprises a lipstick.

26. The method of making a cosmetic sampler as recited in claim 19, wherein said cosmetic comprises a fragrance.

27. The method of making a cosmetic sampler as recited in claim 19, wherein said cosmetic comprises a pharmaceutical.

28. The method of making a cosmetic sampler as recited in claim 19, wherein said cosmetic comprises a lotion.

29. The method of making a cosmetic sampler as recited in claim 19, wherein said integral applicator is formed by applying a layer of fiber material to said base with electrostatic assist.

30. A method of making a cosmetic sampler, comprising the steps of:

forming a well in the upper surface of a base; and screen printing a unit dose of cosmetic directly into said well.

31. The method of making a cosmetic sampler as recited in claims 30, wherein said cosmetic comprises a powder.

32. The method of making a cosmetic sampler as recited in claim 30, wherein said cosmetic comprises a cream.

33. The method of making a cosmetic sampler as recited in claim 30, wherein said cosmetic comprises a lipstick.

34. The method of making a cosmetic sampler as recited in claim 30, wherein said cosmetic comprises a fragrance.

35. The method of making a cosmetic sampler as recited in claim 30, wherein said cosmetic comprises a pharmaceutical.

36. The method of making a cosmetic sampler as recited in claim 30, wherein said cosmetic comprises a lotion.

37. A cosmetic sampler, comprising:

a base having an upper surface;

a unit dose of cosmetic screen printed on the upper surface of said base at a first location; and an integral applicator for sampling said screen printed unit dose of cosmetic, said applicator comprising a strip of material glued to the upper surface of the base at a second location different from said first location.

38. The cosmetic sampler of claim 37, further comprising a perimeter adhesive applied on said base, and a protective overlay laminated to said base by said perimeter adhesive.

39. A cosmetic sampler, comprising:

a base having an upper surface;

a debossed well formed in the upper surface of said base at a first location;

a unit dose of cosmetic screen printed in said debossed well; and an integral applicator for sampling said screen printed unit dose of cosmetic, said applicator comprising a strip of material glued to the upper surface of said base at a second location different from said first location.

40. The cosmetic sampler of claim 39, further comprising a perimeter adhesive applied on said base, and a protective overlay laminated to said base by said perimeter adhesive.

* * * * *